United States Patent [19]

Hahn et al.

[11] Patent Number: 4,684,506

[45] Date of Patent: Aug. 4, 1987

[54] MASTER ALLOY FOR THE PRODUCTION OF TITANIUM-BASED ALLOYS AND METHOD FOR PRODUCING THE MASTER ALLOY

[75] Inventors: Reinhard Hahn, Schwabach-Limbach; Hermann Andörfer, Fürth, both of Fed. Rep. of Germany

[73] Assignee: GFE Gesellschaft fur Elektrometallurgie mbH, Dusseldorf, Fed. Rep. of Germany

[21] Appl. No.: 795,611

[22] Filed: Nov. 6, 1985

[51] Int. Cl.[4] ..... C22C 21/00

[52] U.S. Cl. ..... 420/552; 75/10.18; 420/580

[58] Field of Search ..... 420/552, 580; 75/10 V

[56] References Cited

U.S. PATENT DOCUMENTS 3,387,971 6/1968 Vogt et al. ..... 420/552

*Primary Examiner*—R. Dean

*Attorney, Agent, or Firm*—Karl F. Ross; Herbert Dubno

[57] ABSTRACT

A master alloy for producing titanium-based alloys with high molybdenum content and capable of ensuring the solution and distribution of the molybdenum in the titanium based alloy consists essentially of 25 through 36% by weight molybdenum, 15 to 18% by weight vanadium, up to about 7% by weight titanium, the balance aluminum and wherein the molybdenum content is at least 1.4 times the vanadium content and the melting point is at most 1500° C.

7 Claims, No Drawings

MASTER ALLOY FOR THE PRODUCTION OF TITANIUM-BASED ALLOYS AND METHOD FOR PRODUCING THE MASTER ALLOY

CROSS REFERENCE TO RELATED APPLICATIONS

This application is related to the commercially owned copending applications Ser. No. 621,039, (U.S. Pat. No. 4,582,533), 621,040 (U.S. Pat. No. 4,585,474), and 621,046, (U.S. Pat. No. 4,605,436), all filed June 15, 1984 by Hermann ANDÖRFER, one of the present joint inventors.

FIELD OF THE INVENTION

Our present invention relates to a master alloy for the production of a titanium-based alloy, the master alloy having a molybdenum content in excess of 20% by weight, a vanadium content in excess of 10% by weight and an aluminum content in excess of 40%. Our invention also relates to a process for making this master alloy and to a process for making the titanium-based alloy utilizing the master alloy.

BACKGROUND OF THE INVENTION

It is known to provide a master alloy (see U.S. Pat. No. 3,387,971) which has a molybdenum content of 20 to 25% by weight, a vanadium content of 20 to 25% by weight, no titanium, and the balance of aluminum.

This master alloy is formed in a single stage and its melting point is determined by the fact that the content of molybdenum plus vanadium plus aluminum is always at least 99% as a result of the limited content of carbon, oxygen, nitrogen, and hydrogen, to be less than 1400° C. With a higher molybdenum content of the master alloy, however, problems arise in that molybdenum is only soluble with considerable difficulty in the titanium-based alloy.

The production of titanium-based alloys from master alloys deserves some comment.

Titanium-based alloys containing the elements aluminum, molybdenum and vanadium in different compositions and ratios are commercially significant because of their utility in the fabrication of aircraft and vehicles for space travel. Thus, it is especially important in the fabrication of titanium-based alloys that the alloying elements in the base metal be distributed with an optimum homogeneity so that properties of the metal bodies are substantially isotropic.

Especially metals having high melting points or refractory metals such as molybdenum with a melting point of 2610° C. are difficult to dissolve homogeneously in the lower melting titanium whose melting point is only 1668° C.

Experience has shown that existing aluminum master alloys containing molybdenum have not fully solved this problem. Such aluminum master alloys include $Al_{12}Mo$, $Al_5Mo$, $Al_3Mo$, $Al_2Mo$ and $AlMo_3$. Even with these alloys it is difficult to bring about complete and homogeneous dissolution of molybdenum, even in the form of the master alloy, in the titanium.

Undissolved molybdenum compounds and unmelted molybdenum particles, when distributed in the titanium-based structure, create problems in fabrication and as to the strength of the pieces made from the alloy because at the inclusion sites of the undissolved alloy or the particles, crack formation can occur. The aging properties of the product are poor, the fatigue resistance is low and, in general, practically all of the strength properties are adversely affected.

It is possible to approximate a satisfactory degree of homogeneity in titanium-based alloys by providing the alloying elements in appropriate master alloys and then mixing them with titanium sponge, and pressing the products at sufficient pressures to shaped articles. These shaped articles are then converted by welding in special processes to melting electrodes, which are transformed by electric arc furnace melting to ingots and, utilizing various ingot remelting techniques, the homogeneity of the resulting titanium-based alloys can be increased. These methods are extremely complex and frequently onerous.

OBJECTS OF THE INVENTION

It is the principal object of the invention to provide an improved master alloy which will avoid the drawbacks mentioned above.

Another object of this invention is to provide a master alloy which has a relatively low melting temperature and yet a high molybdenum content, so that it can be used in the fabrication of especially homogeneous titanium-based alloys with improved properties and without the very complex techniques hitherto required to ensure homogeneity.

Still another object of the invention is to provide a master alloy of high molybdenum content with especially high solubility in titanium in the formation of a titanium-based alloy.

Still another object of our invention is to provide an improved method of making a low melting master alloy capable of introducing relatively large amounts of molybdenum into titanium-based alloys.

SUMMARY OF THE INVENTION

We have discovered that it is possible to provide a master alloy having a melting point below 1500° C. and a high molybdenum content which will, surprisingly, facilitate the homogeneous dissolution and distribution of molybdenum in titanium-based alloys.

According to the invention, a master alloy is formed with a molybdenum content of 25 to 36% by weight, a vanadium content of 15 to 18% by weight and the relationship between the molybdenum content and the vanadium content is such that the molybdenum content is at least 1.4 times the vanadium content, the alloy additionally containing 0 to 7% by weight titanium, the balance aluminum. Most advantageously, the Mo content will be above 25% by weight and normally at least 27% by weight.

While it is possible for the alloy to have no titanium, preferably the master alloy of the invention has more than 1% by weight titanium and, in the most preferred state, has about 7% by weight titanium although deviations by about ±1% by weight from this latter value are tolerable.

The melting point of this master alloy is less than 1500° C. and the master alloy itself has not found to be extremely homogeneous.

However, possibly the most surprising characteristic of the invention is that by the aforestated relationship of the molybdenum content to the vanadium content, exceptionally high molybdenum contents can be provided in the master alloy which has an exceptionally good solubility in titanium with substantially complete dissolutions of the molybdenum in the titanium-based alloy.

This is indeed surprising where the molybdenum contents exceeds 25% by weight.

The master alloy of the invention has other advantages as well. For example, it can be comminuted easily and with low energy consumption.

Mention may be made of the fact that master alloys for the production of titanium-based alloys which contain small amounts of titanium have been described in the art (see the German patent document—open application DE-OS No. 28 21 406) but the alloys of this publication are not equivalent to those of the present case and indeed appear to be relevant only to alloys which are to have significant zirconium contents.

The master alloy of the invention can be made in various ways. In a best mode embodiment of the invention, a high-purity molybdenum/aluminum alloy and a high-purity vanadium/aluminum alloy are combined in the requisite proportions to yield the master alloys of the invention with the composition desired and the mixture is combined with aluminum metal and titanium in a vacuum induction furnace to form a melt.

The molybdenum/aluminum alloy and the vanadium-/aluminum alloy may each be formed by aluminothermal reduction and thus have a high degree of purity as introduced into the vacuum induction furnace.

Preferably, we work with a molybdenum/aluminum alloy consisting 75% by weight of molybdenum and 25% by weight of aluminum with a vanadium-/aluminum alloy consisting of 80% by weight of vanadium and 20% by weight of aluminum, aluminum metal with a purity of 99.8% of aluminum and titanium metal with a purity of 99.7% titanium. The vacuum induction furnace is preferably operated so that the bath is agitated or displaced inducted and after the melt is degassed by a vacuum, the melting is continued under a protective gas, e.g. argon, with inductive bath agitation or stirrung until all detrimental aluminum oxide inclusions are removed aluminothermally and a highly homogeneous product is obtained.

The master alloy can then be cast at a temperature of about 1510° C. under an argon atmosphere and cooled at reduced pressure under helium, preferably at a pressure of 200 torr or less.

The titanium-based alloy can be made by a vacuum melting and/or in an electric arc furnace, the solidified master alloy with titanium in the desired proportions for the titanium-based alloy of interest.

SPECIFIC DESCRIPTION AND EXAMPLES

The preferred method of producing the four-component master alloy of the invention utilizes a two-stage process which has been found to ensure an especially dense and inclusion-free master alloy of high homogeneity.

The smelting in the second stage is effected in a vacuum induction furnace which reduces the impurity content of the product to especially low levels, for example a maximum of 0.008% nitrogen and substantially 0.02 to 0.04% oxygen.

In the first step of the process, molybdenum-/aluminum and vanadium/aluminum alloys are formed by aluminothermal reduction in a burn-off oven or furnace by, for example, intimately mixing relatively high purity molybdenum (VI) oxide ($MoO_3$) with a purity of at least 99.9% $MoO_3$ with high purity aluminum and then igniting the reaction mixture.

The aluminothermal reaction ensures an effective separation of the metal from the slag, and the addition of a flux to reduce the viscosity of the slag is not necessary. This is highly important because the elimination of the need for a slag also avoids an opportunity to introduce additional contaminants. Depending upon the stoichiometry of the mixture and reaction the alloy can contain 72 to 75% molybdenum and and 28 to 25% aluminum by weight. The aluminum is of course added in excess to allow burn-off by the oxygen of the $MoO_3$ or the $V_2O_5$.

In the same way high purity $V_2O_5$ is reacted with aluminum to produce the vanadium/aluminum alloy aluminothermally containing 80 to 82% by weight vanadium, 20 to 18% by weight aluminum.

The second stage melting is carried out as described in a vacuum melting furnace with the starting material MoAl 75:25, VAl 80:20, 99.8% purity aluminum and titanium metal of 99.7% purity which are introduced through a vacuum gate into the ceramic crucible and there heated inductively with inductive stirring. After degasification, an argon-protective atmosphere is applied and the stirring of the melt continued in a refining operation to remove even minimal $Al_2O_3$ inclusions. The bath movement ensures optimum homogeneity. The melting process is controlled precisely with monitoring of the melting temperature and the melt is then cast in steel ingot molds under argon and cooling is effected under inert gas partial pressure, preferably helium, at less than 200 torr.

By way of example, two charges are formed (all percents by weight).

Charge 1

Into the vacuum induction furnace are introduced

| | |
|---|---|
| 4.728 kg MoAl | 73.6% Mo |
| 1.852 kg VAl | 80.5% V |
| 0.702 kg Ti-scrap | 99.7% Ti |
| 2.718 kg Al-granules | 99.7% Al |

The mass is melted, degassed and maintained in a liquid state. The casting is effected at 1510° C. under argon and the ingots are cooled for three hours under helium by pressure of 200 Torr.

The product is: 9.51 kg of Al-Mo-V-Ti 43:35:15:7 (percent by weight) with:

| | |
|---|---|
| 41.5% | Al |
| 35.8% | Mo |
| 15.1% | V |
| 6.9% | Ti |
| 0.20% | Fe |
| 0.08% | Si |
| 0.022% | $O_2$ |
| 0.007% | $N_2$ |
| 0.016% | C |
| 0.001% | B |
| 0.015% | Cr |
| 0.002% | Cu |
| 0.002% | Mg |
| 0.003% | Mn |
| 0.009% | Ni |
| 0.008% | P |
| 0.001% | S |
| 0.001% | Pb |
| 0.03% | W |
| 0.002% | Y |

Solidus-Temperature 1420 ± 10° C.
Liquidus-Temperature 1460 ± 15° C.

Charge 2

Into a vacuum induction furnace, the following are introduced:

| | |
|---|---|
| 3.588 kg MoAl | 75.0% Mo |
| 2.210 kg VAl | 81.0% V |
| 0.702 kg T-scrap | 99.7% Ti |
| 3.514 kg Al-granules | 99.7% Al |

Melting was effected as with Charge 1. However the casting temperature was 1420° C. and the product obtained was: 9.85 kg Al-Mo-V-Ti 48:27:18:7 (percents by weight) with:

| | |
|---|---|
| 48.3% | Al |
| 26.1% | Mo |
| 17.9% | V |
| 7.1% | Ti |
| 0.22% | Fe |
| 0.075% | Si |
| 0.028% | $O_2$ |
| 0.008% | $N_2$ |
| 0.01% | C |
| 0.001% | B |
| 0.013% | Cr |
| 0.001% | Cu |
| 0.002% | Mg |
| 0.004% | Mn |
| 0.005% | Ni |
| 0.007% | P |
| 0.001% | S |
| 0.001% | Pb |
| 0.01% | W |
| 0.001% | Y |
| Solidus-Temperature 1330 ± 20° C. | |
| Liquidus-Temperature 1365 ± 20° C. | |

The master alloys of Charges 1 and 2 were readily comminuted in a hammermill and melted in a vacuum furnace or an electric arc furnace with titanium to form titanium-based alloys having a high molybdenum content. The titanium alloys were found to be highly effective in aircraft and space vehicles.

Typical of the alloys which were produced were alloys containing 6% by weight and more molybdenum, vanadium in an amount determined by the master alloy ratio to the molybdenum, aluminum in an amount determined by the master alloy ratio, and titanium.

We claim:

1. A master alloy for the production of titanium-based alloys which consists essentially of 25 to 36% by weight molybdenum, 15 to 18% by weight vanadium, at least some and up to about 7% by weight titanium, the balance aluminum, and wherein the molybdenum content is by weight at least 1.4 times the vanadium content and the master alloy has a melting point below 1500° C.

2. The method of making a master alloy for the production of titanium-based alloy which consists essentially of 25 to 36% by weight molybdenum, 15 to 18% by weight vanadium, 1% to about 7% by weight titanium, the balance aluminum, and wherein the molybdenum content is by weight at least 1.4 times the vanadium content and the master alloy has a melting point below 1500° C., which comprises the steps of:

aluminothermally producing molybdenum-/aluminum and vanadium/aluminum alloys; and melting the molybdenum/aluminum alloy, the vanadium/aluminum alloy, aluminum metal and titanium metal in a vacuum induction furnace and casting the resulting melt, said molybdenum-/aluminum alloy consisting substantially of 75% by weight molybdenum and substantially 25% by weight aluminum, said vanadium/aluminum alloy consisting substantially of 80% by weight vanadium and 20% by weight aluminum and said aluminum metal of 99.8 aluminum purity and said titanium metal of at least 99.7% by weight titanium purity.

3. The method defined in claim 2 wherein the melting in the vacuum induction furnace is effected with inductive movement of the melt in said furnace and, after vacuum degassing, under a protective gas sufficiently to eliminate significant aluminum oxide inclusions and produce a homogeneous molten product.

4. The method defined in claim 3 wherein said homogeneous molten product is cast at a temperature of at most 1510° C. under argon and then cooled under helium at a pressure of at most 200 torr.

5. A master alloy for the production of titanium based alloys which is easily comminutable and has an improved capacity to homogeneously dissolve molybdenum in the titanium based alloys by comparison with titanium-free master alloys of Mo, V and Al, the master alloy containing effective amounts of each of molybdenum, vanadium, titanium and aluminum, having a melting point below 1500° C., and consisting essentially of:

25 to 36% by weight molybdenum, 15 to 18% by weight vanadium such that the molybdenum content is at least 1.4 times the vanadium content, up to about 7% by weight titanium, and balance aluminum.

6. The master alloy defined in claim 5 which contains at least 1% by weight titanium.

7. The master alloy defined in claim 6 which contains about 7% by weight titanium.

* * * * *